US005319166A

United States Patent [19]

Arnold et al.

[11] Patent Number: 5,319,166

[45] Date of Patent: Jun. 7, 1994

[54] MOLDED CASE CIRCUIT BREAKER MODULAR CONTACT ARM ARRANGEMENT

[75] Inventors: David Arnold, Chester; Roger N. Castonguay, Terryville; James L. Rosen, West Hartford, all of Conn.

[73] Assignee: General Electric Company, New York, N.Y.

[21] Appl. No.: 8,428

[22] Filed: Jan. 25, 1993

[51] Int. Cl.[5] ..... H01H 33/02

[52] U.S. Cl. ..... 200/17 R; 200/144 R; 200/147 R

[58] Field of Search ..... 200/144 R, 147 R, 17 R, 200/271, 275, 244

[56] References Cited

U.S. PATENT DOCUMENTS

| | | | |
|---|---|---|---|
| 2,048,114 | 7/1936 | Gano et al. | 200/147 R |
| 3,023,292 | 2/1962 | Stewart | 200/166 |
| 3,033,964 | 5/1962 | Titus | 200/166 |
| 3,073,936 | 1/1963 | Baird | 200/168 |
| 4,375,021 | 2/1983 | Pardini et al. | 200/147 |
| 4,733,033 | 3/1988 | Morris et al. | 200/153 |
| 4,733,211 | 3/1988 | Castonguay et al. | 335/192 |
| 4,736,174 | 4/1988 | Castonguay et al. | 335/167 |
| 4,741,002 | 4/1988 | Dougherty | 377/49 |
| 4,757,294 | 7/1988 | Todaro et al. | 435/202 |
| 4,931,603 | 6/1990 | Castonguay et al. | 200/144 |

OTHER PUBLICATIONS

Ser. No. 07/764,287 entitled "Molded Case Circuit Breaker Movable Contact Arm Arrangement", filed Sep. 23, 1991 Bellino et al. (Docket 41PR-6938).

*Primary Examiner*—A. D. Pellinen
*Assistant Examiner*—Michael A. Friedhofer
*Attorney, Agent, or Firm*—Richard A. Menelly

[57] ABSTRACT

A molded case circuit breaker movable contact arm electrically connects with the circuit breaker load terminal by means of parallel electric paths provided by a looped braid conductor. The contact arm support includes a single support leg for pivotally retaining the movable contact arm on one side. The opposite side of the contact arm is supported on the operating mechanism crossbar. Contact arms of increasing thickness are used to accommodate the higher transport currents required with circuit breakers of increased ampere ratings.

6 Claims, 2 Drawing Sheets

MOLDED CASE CIRCUIT BREAKER MODULAR CONTACT ARM ARRANGEMENT

BACKGROUND OF THE INVENTION

Complete automation of molded case circuit breaker components by robotic assembly has not heretofore been completely successful. One impediment to complete robotic assembly is the attachment of a flexible conductive braid between the circuit breaker contact and the circuit breaker load terminal lug.

Early attempts to eliminate the electrical contact braid are found in U.S. Pat. Nos. 3,023,292, 3,033,964 and 3,073,936 wherein a pair of contact arms are supported on a contact arm support by means of a pivot pin and a thick spring clip is fastened to the contact arm support and arranged around both the contact arms and the support. Direct electrical connection between the spring clip and the terminal conductor in some industrial-rated circuit breaker designs advantageously improves the electrical conduction between the terminal conductor and the movable contact arm by electromagnetic forces of attraction generated by the current through the spring clip. The increasing electric current increases the electromagnetic force on the juncture between the movable contact arm and the terminal conductor to create an increasing compressive force therebetween.

In lower ampere-rated current-limiting industrial circuit breakers, the forces exerted by the spring clip on the movable contact arm and the terminal conductor must remain relatively constant with increasing current to ensure that the contacts can be electrodynamically repulsed and separated under high current faults such as those occurring with short circuits. The contact arm must rapidly move about its pivot in the early stages of the current wave-form to separate the contacts with minimum let-through current at the instant of separation. This is not easily obtained when the compressive forces on the movable contact arm and the terminal conductor substantially increase at the time the movable contact arm is required to rotate about its pivot.

A more recent design that enables a braidless movable contact arm that is robotically assembled is described in U.S. Pat. No. 4,733,033. This patent discloses the use of a spring having a planar configuration capable of holding the contact arm against its support posts with sufficient force to maintain electrical contact during overcurrent conditions. When this design is used within higher ampere-rated current limiting industrial circuit breakers, a parallel current path should be connected between the movable contact arms and the contact arm support posts to prevent the occurrence of arcing between the contact arm and the support posts under intense short-circuit overcurrent conditions.

U.S. Pat. No. 4,931,603 describes the use of bifurcated shunt plates to reduce the occurrence of arcing between the movable contact arm and the support posts. U.S. patent application Ser. No. 764,287 filed Sep. 23, 1991 describes the addition of a flexible braid conductor of reduced diameter in combination with a U-shaped spring in lieu of the bifurcated shunt plates, as a cost improvement. To use the smaller braid conductor, an offset tab is welded between the end of the braid conductor and the contact arm support plate to prevent the braid from becoming frayed upon long term subjection to flexing under high current conditions.

In a further attempt at cost reducing the movable contact arm assembly, it was discovered that the proposed contact arm assembly could be used over a wide range of ampere ratings without requiring a separate assembly for each increasing ampere rating.

One purpose of the instant invention accordingly is to describe a movable contact arm assembly that includes a parallel current path between a single movable contact arm support leg and a pair of flexible braid conductors attached to the movable contact arm support.

SUMMARY OF THE INVENTION

A molded case circuit breaker movable contact arm is pivotally-arranged between a single support post and the crossbar within the operating mechanism assembly. A pair of braid conductors are attached between the movable contact arm and the support plate in a U-shaped arrangement to promote flex without fraying. Movable contact arms of increasing ampacity are arranged on the support arm to accommodate higher ampere ratings.

DESCRIPTION OF THE PREFERRED EMBODIMENT

Figure 1:
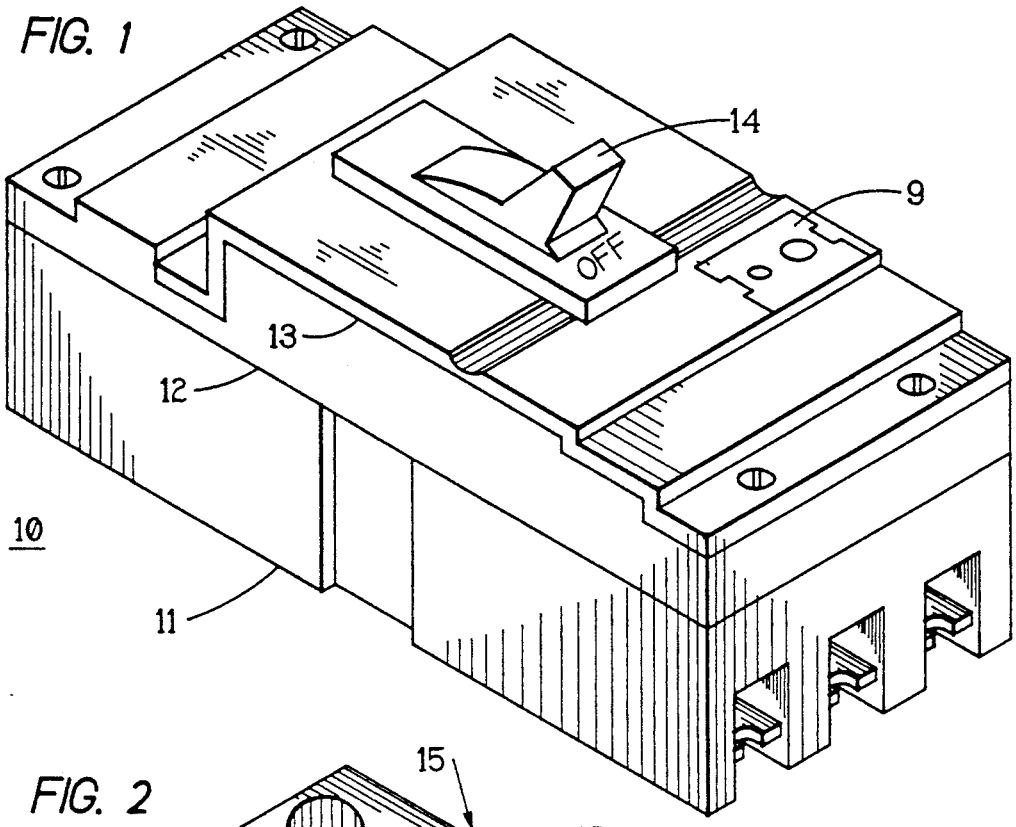
FIG. 1 is a top perspective view of a molded case circuit breaker including the movable contact arm arrangement in accordance with the invention.
Figure 2:
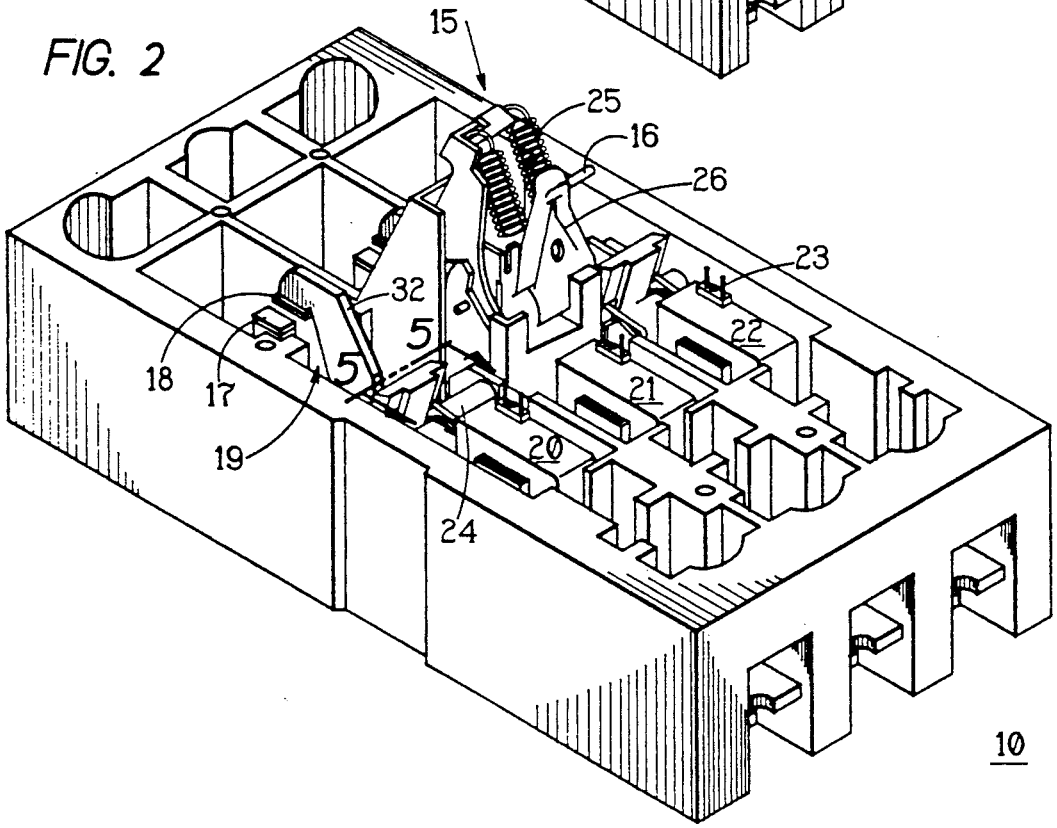
FIG. 2 is a top perspective view of the molded case circuit breaker of FIG. 1 with the cover removed to depict the circuit breaker operating mechanism assembly.

A current limiting circuit breaker 10 is depicted in FIG. 1 and consists of a case 11 to which a cover 12 is attached and which further includes an accessory cover 13. A rating plug 9 is received within the circuit breaker cover and interfaces with an electronic trip unit, also contained within the circuit breaker cover, to set the ampere rating of the trip unit circuit. The trip unit, not shown, is similar to that described within U.S. Pat. No. 4,741,002. A circuit breaker operating handle 14 extends upward from a slot formed within the circuit breaker cover for manual intervention to turn the circuit breaker to its ON and OFF conditions. As described in U.S. Pat. No. 4,757,294, an actuator unit interfaces between the electronic trip unit and an operating mechanism 15 by means of a trip bar 16 to separate the circuit breaker fixed and movable contacts 17, 18 as best seen by referring now to FIG. 2. The operating mechanism 15 acts upon the movable contact arm assembly 19 to drive the movable contact arm 32 to the open position, shown in FIG. 2, upon the occurrence of overcurrent conditions of a predetermined magnitude. The circuit current is sensed by means of current transformers 20–22 which connect with the circuit breaker trip unit by means of pins 23. A molded plastic crossbar arrangement 24, such as described in U.S. Pat. No. 4,733,211, interacts with the movable contact arm assembly 19 to insure that the movable contact arms 32 operate in unison when the operating mechanism 15 is articulated. The operating mechanism is held against the bias of a pair of powerful operating springs 25 by means of a latch assembly 26, in the manner described in U.S. Pat. No. 4,736,174.

In order to provide the current limiting functions described earlier, the movable contact arms 32 are arranged for independent movement from the crossbar assembly by electrodynamic repulsion acting on the movable contact arm itself. One such example of a current limiting circuit breaker is found within U.S. Pat. No. 4,375,021, which patent should be reviewed for its teachings of electrodynamic repulsion of a movable contact arm under intense overcurrent conditions through the circuit breaker contacts.

Figure 3:
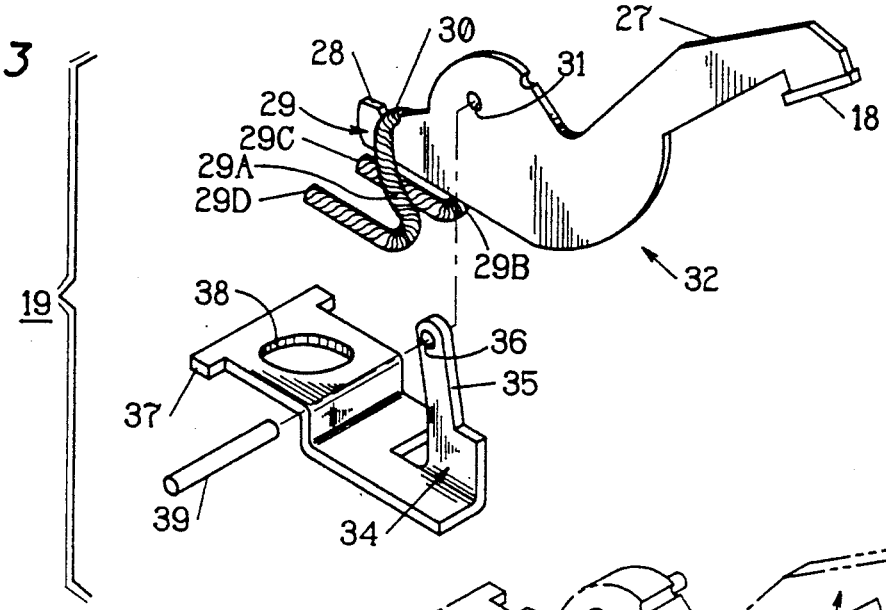
FIG. 3 is an enlarged top perspective view of the contact arm arrangement of the invention with the components in isometric projection.

When such intense overcurrent conditions occur, it is important that the movable contact arms maintain good electrical contact while the movable contacts move away from the fixed contacts. The movable contact assembly 19 shown in FIG. 3 improves over both the braidless movable contact arm described within the aforementioned U.S. Pat. No. 4,733,033 and the single braid arrangement described within the aforementioned U.S. patent application by the provision of a looped contact braid 29 welded or brazed to the movable contact arm 32 at a central part of the loop as indicated at 30. The two legs of the loop 29A, 29B define a reverse C-shaped configuration with the ends terminating in flattened portions 29C, 29D for ease in attaching to the contact arm support 34. The movable contact arm 32 defines a contact end 27 to which the movable contact 18 is attached and a braid end 28 to which the looped braid conductor 29 is attached. The contact arm support 34 includes an angulated base plate 37 having a thru-hole 38 for attachment to the line or load terminal connector (not shown) and a single upstanding support arm 35 which includes a thru-hole 36 which aligns with the thru-hole 31 in the movable contact arm 32 to pivotally attach the movable contact am 32 to the support arm 35 by means of the extended pivot pin 39.

Figure 4:
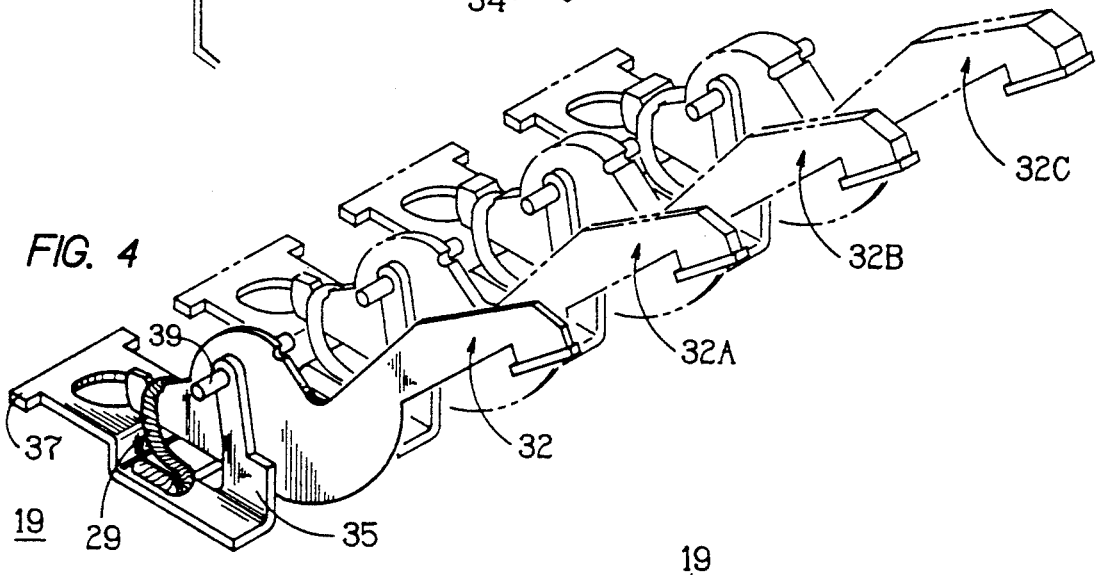
FIG. 4 is an enlarged top perspective view of the assembled contact arm arrangement of FIG. 3.

The complete movable contact arm assembly 19 is shown in FIG. 4 with the movable contact arm 32 pivotally attached to the base plate 37 by means of the pivot pin 39 and support arm 35. The looped contact braid 29 is shown attached to both the base plate and the movable contact arm. Additional contact arms 32A–32C of increased thickness are depicted in phantom to show the replacement of the movable contact arm 32 on the pivot pin 39 to accommodate increasing circuit breaker ampere ratings upon a common base plate 37.

Figure 5:
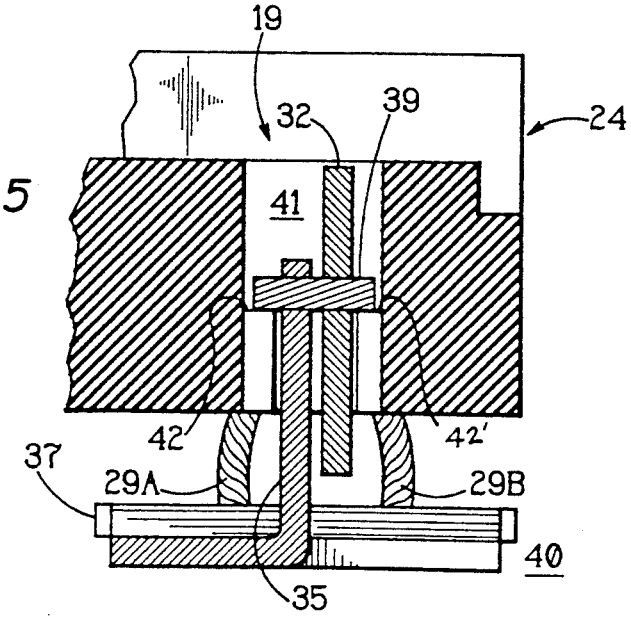
FIG. 5 is an enlarged cross sectional view of a part of the movable contact arm depicted in FIG. 1.

A subassembly 40 within the circuit breaker 10 of FIG. 1 is depicted in FIG. 5 and consists of a base plate 37 with a movable contact arm 32 supported thereon and with the legs 29A, 29B of the looped contact braid arranged on either side. The movable contact arm 32 is attached to the support arm 35 on one side by means of the pivot pin 39, as indicated. The movable contact arm assembly 19 is positioned within a rectangular slot 41 formed within the crossbar 24 such that the ends of the pivot pin 39 are supported upon the bottom shelves 42, 42' of the slot 41. Additional space is accordingly provided within the slot 41 for accommodating movable contact arms of greater thickness, as described earlier.

A movable contact arm assembly has herein been described whereby one such assembly accommodates a plurality of movable contact arms of increasing thickness for use within circuit breakers of increased rating without further change to any of the remaining circuit breaker components.

Having thus described our invention, what we claim as new and desire to secure by Letters Patent are:

1. A movable contact arm assembly for molded case circuit breakers comprising:

an electrically-conductive base plate having terminal screw receiving means at one end and an upstanding support arm at an opposite end;

a movable contact arm pivotally-attached to said support arm and having a movable contact attached to one end;

a looped braid conductor having a central part attached to an opposite end of said movable contact arm and a pair of opposing parallel legs extending from said contact arm to said base plate, said parallel legs being arranged in a reverse C-shaped configuration for reducing fraying of said looped braid conductor during repeated movement of said movable contact arm; and an elongated pivot pin extending through said support arm and through said movable contact arm, one end of said pivot pin being adapted for support within an operating mechanism crossbar assembly.

2. The movable contact arm assembly of claim 1 wherein said parallel legs terminate in corresponding ends, said ends being attached to said base plate on opposite sides of said terminal screw receiving means.

3. The movable contact arm assembly of claim 1 wherein said terminal screw receiving means comprises a threaded opening.

4. A molded case circuit breaker comprising:

a plastic case and a plastic cover forming an enclosure;

an operating mechanism and a crossbar within said case arranged for separating a pair of contacts upon occurrence of an overcurrent condition;

an electrically-conductive base plate within said case, said base plate having terminal screw receiving means at one end and an upstanding support arm at an opposite end;

a movable contact arm pivotally-attached to said support arm, one of said contacts being attached to one end of said movable contact arm;

a looped braid conductor having a central part attached to an opposite end of said movable contact arm and a pair of opposing parallel legs extending from said contact arm to said base plate, said parallel legs being arranged in a reverse C-shaped configuration for reducing fraying of said looped braid conductor during repeated movement of said movable contact arm; and an elongated pivot pin extending through said support arm and through said movable contact arm, one end of said pivot pin being adapted for support within an operating mechanism crossbar assembly.

5. The molded case circuit breaker of claim 4 wherein said parallel legs terminate in corresponding ends, said ends being attached to said base plate on opposite sides of said terminal receiving means.

6. The molded case circuit breaker of claim 4 wherein said terminal receiving means comprises a threaded opening.

* * * * *